United States Patent [19]

Wain

[11] 3,940,888

[45] Mar. 2, 1976

[54] FACETING DEVICE FOR GEMSTONES

[76] Inventor: Harry C. Wain, Stafford Industrial Park P.O. Box 84, Stafford Springs, Conn. 06076

[22] Filed: Jan. 31, 1975

[21] Appl. No.: 545,878

[52] U.S. Cl. ..... 51/229

[51] Int. Cl.[2] ..... B24B 19/00

[58] Field of Search ..... 51/229, 216 ND, 216 H; 33/174 TD, 1 D; 279/5

[56] References Cited

UNITED STATES PATENTS

| | | | |
|---|---|---|---|
| 2,452,089 | 10/1948 | Wiken | 33/174 TD UX |
| 3,688,452 | 9/1972 | Stevens | 51/229 |
| 3,818,041 | 6/1974 | Long | 51/229 X |

*Primary Examiner*—Harold D. Whitehead
*Attorney, Agent, or Firm*—Berman, Aisenberg & Platt

[57] ABSTRACT

A gemstone faceting machine for properly orienting a gemstone for forming facets thereon in a plurality of coaxial rows with equal spacing of the facets in the rows. A dop stick is provided on the end of a faceting shaft secured in a quill sleeve rotatably mounted in a faceting head (which can be angularly adjusted for different facet rows to be formed). A spring-biased detent trigger is pivoted on the bracket to engage between the teeth of an indexing gear secured on a collar on the quill sleeve near the other end of the shaft. A positioning pin is secured to the collar and projects through the gear. A guide disc having evenly spaced peripheral notches is engaged around and can be rotated on a flanged bushing threadably engaged on the quill sleeve adjacent the gear, and a coil spring is provided on the bushing, urging the disc toward the gear. The disc has respective holes spaced to receive the pin to establish the angular relationship between the successive rows of evenly spaced facets. The notches on the disc guide the detent trigger into engagement between the gear teeth for assuring uniform angular rotational steps of the shaft in forming the facets of a particular row.

7 Claims, 8 Drawing Figures

FACETING DEVICE FOR GEMSTONES

This invention relates to gemstone grinding and polishing machines, and more particularly to machines for holding gemstones in proper positions for forming facets thereon.

A main object of the invention is to provide a novel and improved facet-forming holder for a gemstone, the holder being relatively simple in construction, being easy to operate, and which greatly speeds up, simplifies and reduces chances for error in the positioning of a gemstone for the grinding and polishing of faces or facets on its surface.

A further object of the invention is to provide an improved gemstone faceting machine which enables facets to be formed on a gemstone in an accurately oriented manner, the machine involving relatively inexpensive parts, being easily adjustable to angularly orient a gemstone held thereon for faceting, and enabling an operator to form the facets on a gemstone without requiring painstaking attention to the orientation of the stone except by following a specified procedure in the operation of the machine which assures the accurate positioning of the gemstone in an automatic manner.

A still further object of the invention is to provide an improved gemstone faceting machine which enables facets to be formed on a gemstone with equal spacings for each row of facets and which can be angularly adjusted for different facet rows to be formed, the machine having the capacity for relocating facets accurately after they have once been formed for repeated grinding or polishing actions on the facets, and enabling the complete faceting operation to be performed on a gemstone in a relatively short period of time and with minimum chance for error in indexing.

Further objects and advantages of the invention will become apparent from the following description and claims, and from the accompanying drawings, wherein:

Figure 1:
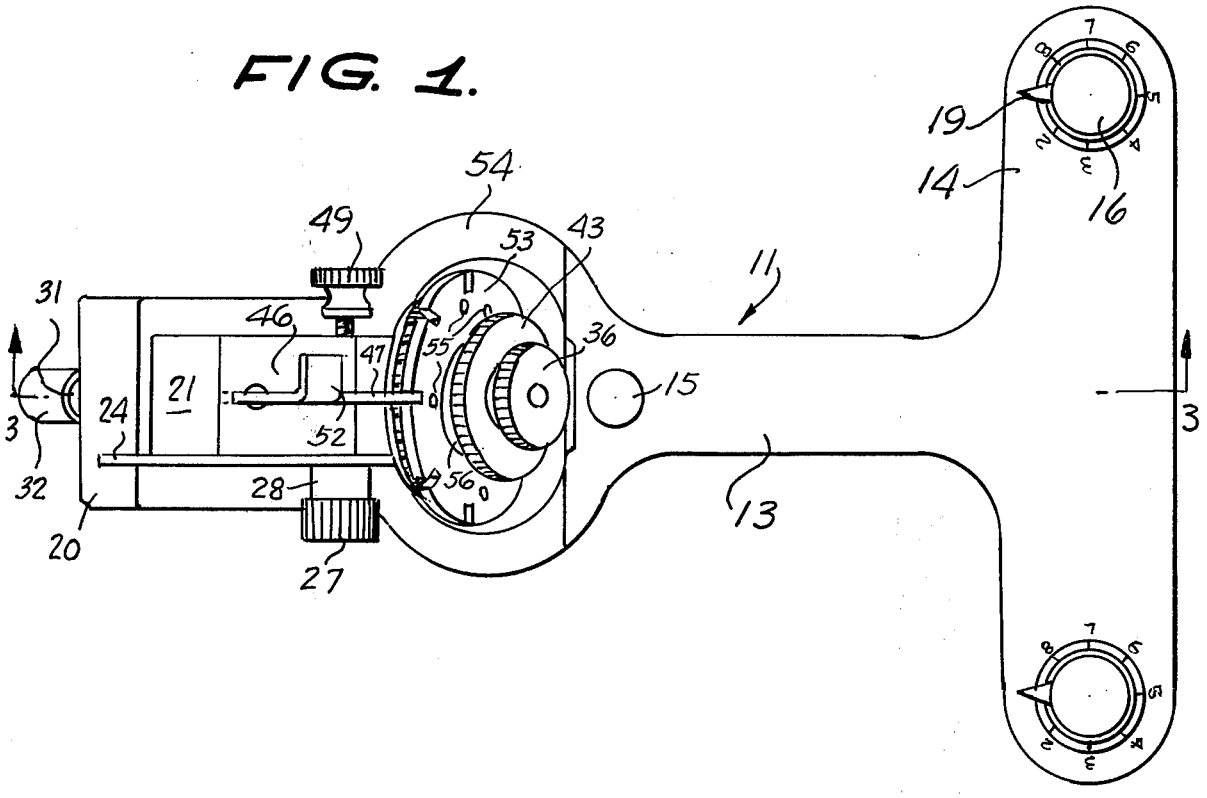
FIG. 1 is a top plan view of an improved gemstone faceting machine constructed in accordance with the present invention.

To enhance their sparkle, transparent gemstones are commonly ground and polished with a series of flat faces or facets covering their surfaces. A common diamond engagement ring is an example of a faceted gemstone.

In the early history of gemstone cutting, these facets were located visually and were therefore not precisely positioned. As the art of gem cutting developed, it was found that the positions of the facets affected the brilliance of the stone and that certain specific arrangements of the facets resulted in more sparkle in the cut stone.

As the science of optics evolved, the optimum positioning of the facets was further defined, and at the present time there is extensive information in the form of charts, and the like, defining the precise location of each of the dozens of facets on a typical gemstone.

In order to hold the gemstone while the facets are ground and polished, it is cemented to a bar or "dop". In a modern facet-cutting machine, the dop is mounted in an indexing device, called a "faceting head" which is used to position the stone precisely for cutting and polishing each facet.

The angle of the stone with the vertical is set by means of a protractor built into the faceting head. Once the vertical angle is set, the facets are located at precise intervals around the stone by engaging a trigger member in notches in a gear wheel or index wheel which is fastened to the dop or to the quill in which the dop is clamped.

Perhaps 90% of all faceted stones are finished in a "brillant cut" which consists of seven rows of eight facets plus a flat top or table for a total of 57 facets. Since each facet must be positioned for cutting and polishing at least three times, and more usually four to six times, it is obvious that there is a considerable value in any device that speeds up this indexing and reduces the chance for error in indexing.

While the standard brilliant cut has seven rows of eight facets, three of the rows are in line with other rows so that a total of four different positions of eight facets are required for a total of 32 positions around the stone. Since the spacings are regular, a 32-tooth gear wheel is used to located the facets. To allow for modifications of the standard cut, a 64-tooth gear wheel is often used, or for even more versatility, a 96-tooth gear wheel may be used.

After the angle of the faceting head is set for cutting one row of facets, it is necessary to position each of the eight facets in that row by selecting, one at a time, the correct eight positions of the teeth on the gear wheel. The trigger member is set into the proper notch, and one facet is partially ground. Then, the next facet is positioned by setting the trigger in the next correct notch, and that facet is partially ground. This is continued until all eight facets are partially ground. This series of steps is repeated until all the facets are ground to a depth where the corners of the facets just meet. If one facet is cut too deep, it is then necessary to re-cut all the facets in that row to match the deep one.

Since this positioning of the facet is usually repeated several times for the rough grinding step, and at least once each for the fine grinding and polishing steps, it is common to index each of the 57 facets four to six times for a total of about 300 settings for each stone cut. For each of these settings, the trigger member must be set in exactly the right notch. Just one error in this 300 or more settings may mean that the whole stone must be re-cut to a smaller size. Finding the right notch is painstacking work with a 32-tooth gear wheel. It is even more difficult with the more versatile 64-tooth or 96-tooth gear wheels.

The facet-locating device incorporated in the present invention allows the trigger member to be quickly set in the correct eight positions for each row of facets, and with no possibility of error. In fact, with the present invention, the machine operator can, with his eyes closed, index to the correct notch in less than 1 second.

The facet finding means comprising the present invention includes a thin circular disc or shield slightly larger in diameter than the gear wheel and held against it. The disc may preferably be of transparent plastic so that the gear wheel notch numbers can be read through the facet-locating disc. In a typical embodiment, eight evenly spaced notches are cut in the periphery of the facet-locating disc. This disc prevents the trigger member from entering any notch in the gear wheel except the eight correct gear wheel notches exposed by the eight guide notches in the facet-locating disc. After one row of eight evenly spaced "main" facets is cut, the facet head angle is set for another row, namely, for forming the "star" facets.

For cutting the first eight facets, namely, the "main" row facet-locating disc is positioned positively by means of a locating pin provided on the associated indexing gear wheel. The facet locating disc is therefore provided with a hole adapted to receive the pin. Similarly, to reposition the facet-locating disc, for cutting the "star" facets, the disc is retracted against the force of a biasing spring and is rotated until the corresponding hole in the disc can be engaged over the pin. Thus, the operator pulls back the facet-locating disc and rotates it until the proper hole for the "star" facets registers with the pin, after which the locating disc is released, placing it in the proper position to guide the trigger member for engagement for forming the "star" facets. Similarly, the two positions for the "girdle" facets are cut by locating corresponding holes on the facet-locating disc so that they can be engaged with the aforesaid pin. After the four rows of facets are cut on the top of the gemstone, the stone is reversed in position and the three required additional sets of facets are cut on the bottom of the stone, using the same facet-locating procedure.

It will be further understood that the above-described facet-locating procedure is adaptable to other cuts than for the 32-position brilliant cut, and for use with other gear wheels. Also, the re-positioning of the facet-locating disc for each row of facets can be accomplished by other means than the specific pin means presently to be described. Thus, any desired type of interengageable locking means on the disc and indexing gear may be employed to interlock the disc and gear in a plurality of different angular relationships to each other.

Referring to the drawings, 11 generally designates a gemstone faceting holder constructed in accordance with the present invention. The holder 11 comprises a support 12 generally in the form of a T-shaped member having a main stem portion 13 and outwardly projecting end wing portions 14, 14. The main stem portion 13 is provided with a leveling screw 15 and the wing portions 14, 14 are likewise provided with respective leveling screw members 16, 16, the leveling screws being employed to horizontally position the base member 12 on a suitable supporting table 18. The leveling screw members 15 and 16, 16 are suitably provided with manually operable knobs for adjusting same, and the leveling screw members 15 are provided with number scales cooperating with pointer elements 19 on their knobs, as shown in FIG. 1.

Figure 2:
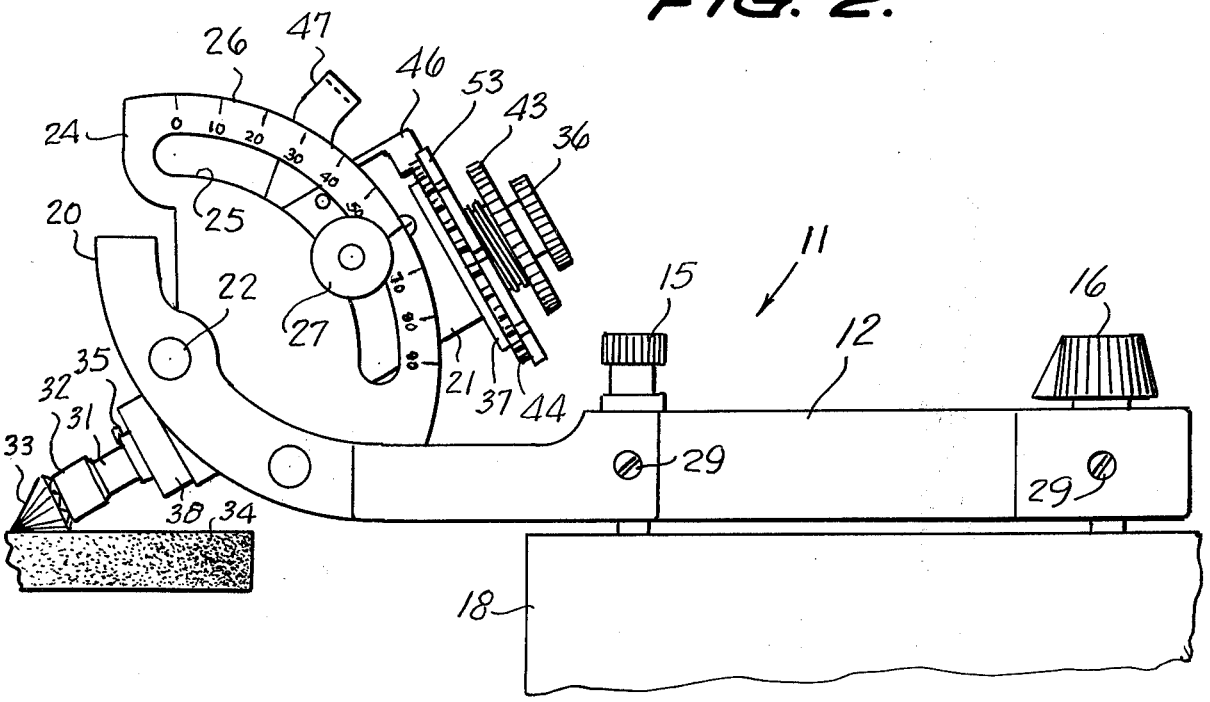
FIG. 2 is an elevational view of the gemstone faceting machine of FIG. 1.
Figure 3:
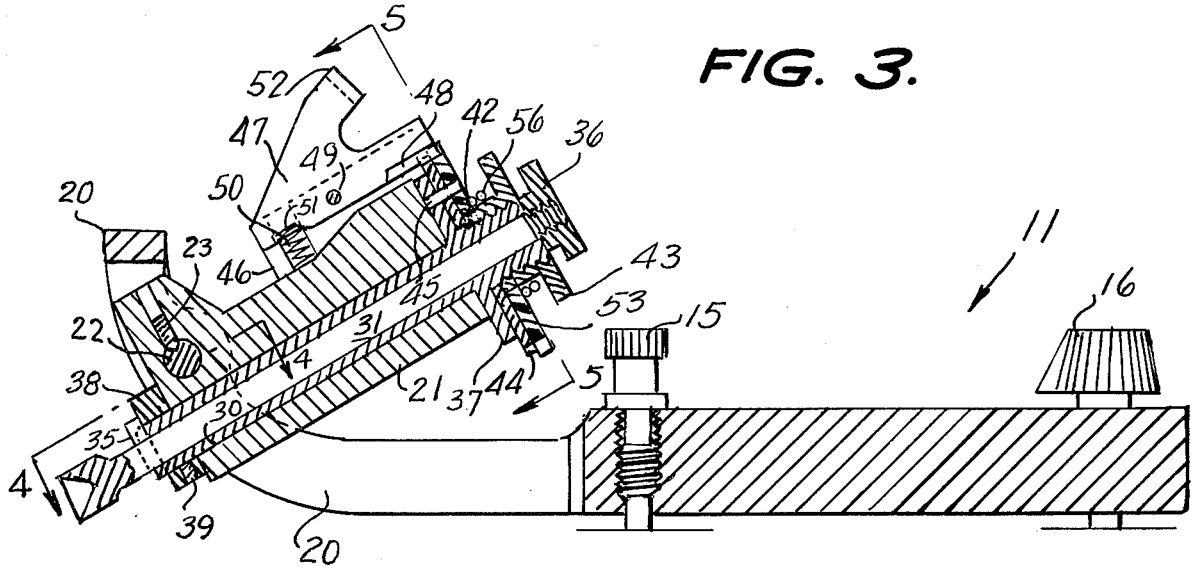
FIG. 3 is a longitudinal vertical cross-sectional view taken through the faceting machine substantially on a line 3—3 of FIG. 1.
Figure 4:
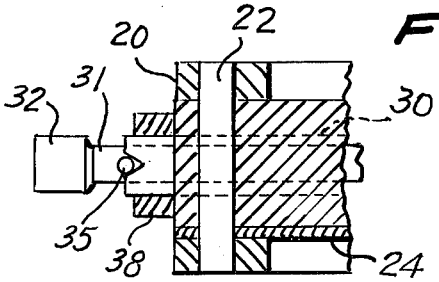
FIG. 4 is a fragmentary cross-sectional view taken substantially on a line 4—4 of FIG. 3.

The base member 12 is formed with a forwardly projecting arcuate arm 20 which is of generally U-shaped construction between the side arms of which is horizontally pivoted an angularly adjustable bracket member 21, for example, by a transversely extending pivot shaft 22 rotatably engaged in the side arm portions and lockingly secured to the bracket member 21 by a set screw 22, as shown in FIG. 3. Rigidly secured in the U-shaped member 20 adjacent one of its side arm portions is an arcuate protractor plate 24 having an arcuate slot 25 and an angle scale 26, the arcuate edge of the plate 24 being concentric with the pivot shaft 22, and the slot 25 being likewise concentric with said shaft, as shown in FIG. 2. A clamping screw member is threadedly engaged with the bracket member 21, said screw member being shown at 27, the screw member having a clamping shoulder 28. Said screw member is engaged through the arcuate slot 25 in a position such that the shoulder 28 may be utilized to clamp the bracket member 21 in an adjusted position along the angle scale 26 by the clamping engagement of its shoulder portion 28 with the protractor plate member 24, as will be apparent from FIGS. 1 and 2.

As shown in FIG. 2, the leveling screws 15 and 16, 16 are provided with clamping set screws 29 for locking them in adjusted positions relative to the supporting table 18.

Rotatably supported in the bracket member 21 in a downwardly and forwardly inclined position is a sleeve member 30 accurately oriented to be rotated in a vertical plane when the bracket member 21 is angularly adjusted around its pivot shaft 22. Supportingly contained in the sleeve member 30 is a dop stick shaft 31 which is provided at its lower end with a conventional socket 32 in which a gemstone to be faceted, shown at 33, may be cemented in a conventional manner. Thus, the dop stick means 31 holds the gemstone 33 in a position to be abraded by a conventional lapping wheel 34 in the manner illustrated in FIG. 2. A key or "quill" element 35 is engaged through the lower portion of the shaft member 31, and a clamping nut 36 is threadedly engaged on the upper end of the shaft member 31 which is clampingly engageable against the upper end of the sleeve member 30 to lock the shaft member 31 rigidly in the sleeve member when the nut 36 is tightened.

The sleeve member 30 is formed with an outwardly projecting annular flange 37 which rotatably engages against the upper end portion of the bracket member 21. A retaining collar 38 surrounds the lower end portion of the sleeve member 30 and is secured thereto by means of a setscrew 39, as shown in FIG. 3.

The upper end portion of the sleeve member 30 is externally threaded, as shown at 41 and a bushing member 42 is threadedly engaged therewith, said bushing member being provided with an outwardly extending annular flange 43. Surrounding the sleeve member 30 upwardly adjacent the flange 37 is a conventional peripherally toothed indexing gear 44 which is held fixed relative to flange 37 by means of an outwardly projecting pin member 45 engaging through an aperture in gear 44 and rigidly secured in flange 37. The top portion of bracket member 21 is formed with a pair of longitudinal spaced ribs 46, 46 between which is pivoted a trigger lever 47 having a V-shaped bottom outer edge portion 48 engageable between the teeth of gear 44, the trigger lever 47 being pivoted on a transverse pivot pin 49 extending between the ribs 46, 46 and being biased in a clockwise direction, as viewed in FIG. 3, by a coil spring 50 whose upper end is received in a suitable notch 51 provided therefor in the bottom edge of trigger lever 47 and whose lower end bears on bracket member 21 between the ribs 46, 46 as is clearly shown on FIG. 3. Trigger level 47 is provided with a gripping tab 52 for manually rotating the trigger level in a counterclockwise direction, as viewed in FIG. 3, to disengage detent portion 48 thereof from between the teeth of the indexing gear 44, as will be presently described.

The gear 44 may be provided with conventional numerical markings visible from the right side of the holder 11, as viewed in FIGS. 1, 2 and 3, to indicate its instantaneous angular position.

Figure 5:
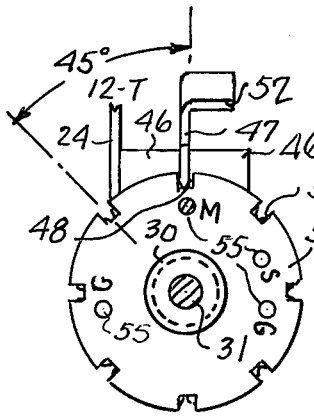
FIGS. 5, 6, 7 and 8 are respective cross-sectional views taken substantially on a line 5—5 of FIG. 3 and showing the adjustable guide disc member of the machine set for forming different rows of facets on a gemstone mounted in the machine for faceting.
Figure 6:
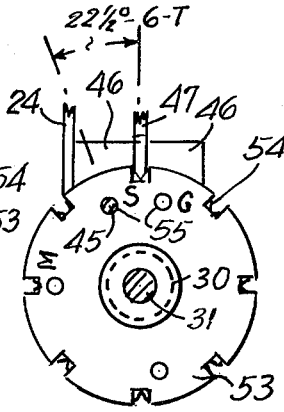
Figure 7:
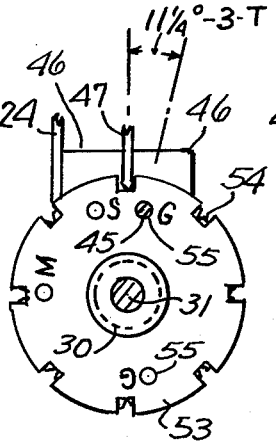
Figure 8:
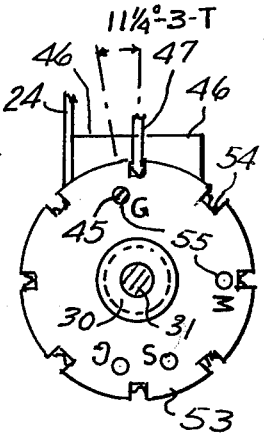

Gear 44 may be locked against flange 37 by tightening the bushing 42. Surrounding the bushing 42 is an indexing disc or wheel 53 of suitable transparent, rigid material, having evenly spaced peripheral notches 54 and having a plurality of apertures 55 located so that pin 45 is receivable therein at various selected positions of adjustment of wheel 53 relative to gear 44. Thus, in FIG. 5, the pin 45 is received in the aperture 55 marked M, providing the proper angular relationship between wheel 53 and gear 44 for the "main" facets. FIG. 6 shows the pin 45 engaged in another aperture 55 to provide the desired angular relationship between wheel 53 and gear 44 for the "star" row of facets. This aperture is marked S on wheel 53. In FIG. 7, the pin 45 is shown engaged through the aperture 55 marked G on the wheel 53, corresponding to the adjustment for the first row of "girdle" facets. FIG. 8 shows the pin 45 engaged in the second aperture 55 marked G on wheel 53, providing the setting of wheel 53 relative to gear 44 for the second row of " girdle" facets.

Surrounding the bushing 42 and bearing between flange 43 and wheel 53 is a coiled spring 56 which holds the wheel 53 against gear 44 and thereby maintains locking interengagement therebetween. Thus, when it is desired to change the setting of wheel 53 relative to gear 44, the wheel 53 is pulled rightwardly, as viewed in FIG. 3, to disengage it from the pin 45, after which, the wheel can be rotated to the new setting and released, to allow pin 45 to enter another aperture 55. It is therefore very easy to change the setting of the wheel 53 relative to the gear 44, for example, from shifting from one row of facets to the next in the faceting operation.

As shown in FIGS. 5 to 8, the wheel 53 is slightly larger in diameter than the gear 44 so that the teeth of the gear will be exposed in the notches 54, allowing the trigger lever to engage between adjacent gear teeth when the trigger lever is received in one of the notches 54. Also, since the wheel 53 is transparent, the gear notch members can be read through wheel 53.

Thus, in the particular embodiment illustrated, the trigger lever edge 48 can be quickly set in the correct eight positions for each row of facets with no possibility of error.

As will be understood by those skilled in the art, while the standard brilliant cut has seven rows of eight facets, three of the rows are in line with other rows, so that a total of four different positions of each facet are required, for a total of 32 positions around the stone. Since the spacings are regular, a 32-tooth gear wheel is used to locate the facets. For modifications of the standard cut, a 64-tooth gear wheel may be used, or even a 96-tooth gear wheel for more versatility.

In operation, after the angle of the faceting head assembly is set for cutting the first row of facets, by means of the protractor scale 26, it is then necessary to position each of the eight facets in the first row by selecting, one at a time, the correct eight positions of teeth to be engaged on the gear 44. The trigger member 47 is set into the proper notch, with the pin 45 engaged in the M aperture 55, and one facet is partially ground. Then the next facet is positioned by setting the trigger lever 24 in the next correct notch 54 and that facet is partially ground. This is continued until all eight facets are partially ground. This series of steps is repeated until all the facets are ground to a depth where the corners of the facets just meet. If one facet is cut too deep, it is then necessary to re-cut all the facets in that row to match the deep one.

To reposition the wheel 53 for cutting the "star" facets, the wheel 53 is pulled back against the biasing force of spring 56, as above explained, and wheel 53 is then rotated until the aperture 55 corresponding to the "star" facets comes into registry with the pin 45 and is released. At this time, the "star" facets can be cut, with the proper angular adjustments of dop stick shaft 31 relative to the protractor scale 26.

Similarly, the two positions of "girdle" facets are cut by locating the G apertures 55 in positions to receive the pin 45 in the manner above described. After the four rows of facets are cut on the top of the gemstone 33, the stone is removed and re-installed in reverse position, and the three required sets of facets are cut on the bottom of the stone, using a procedure similar to that above described, namely, by properly positioning the wheel 53.

It should be noted that in a procedure such as that above described, the positioning of each facet is usually repeated several times for the rough grinding step and at least once for each of the fine grinding and polishing steps, wherein it is common to index each of the 57 facets four to six times, for a total of 300 settings for each stone cut. For each of these settings, the trigger member 47 must be set in exactly the right notch 54, since one error in the approximately three hundred setting may mean that the entire stone must be re-cut to a smaller size. Finding the correct notch is painstaking work with a 32-tooth gear wheel 44. It is even more difficult with the more versatile 64-tooth gear wheel or the 96-tooth gear wheel. The use of the indexing wheel 53, as above described, allows the trigger member 47 to be quickly set in the correct eight positions for each row of facets with no possibility of error, as above explained, since disc 53 prevents the trigger member 47 from entering any notched portion of gear wheel 44 except the eight correct notched portions exposed by the eight notches 54 in the indexing wheel 53.

While a specific embodiment of an improved gemstone faceting holder has been disclosed in the foregoing description, it will be understood that various modifications within the spirit of the invention may occur to those skilled in the art. Therefore it is intended that no limitations be placed on the invention except as defined by the scope of the appended claims.

What is claimed is:

1. A gemstone faceting holder comprising a support, an angularly adjustable bracket member on said support provided with angle-indicating means, a sleeve member rotatably mounted in said bracket member, dop stick means secured in said sleeve member, a peripherally toothed indexing gear secured on said sleeve member, a spring-biased trigger lever pivoted on said bracket member and being engageable with the toothed periphery of the gear to fix the position of said dop stick means, an indexing wheel rotatably mounted on the sleeve member and having evenly spaced peripheral guide notches for the trigger lever, interengaging locking means on the wheel and gear to interlock the wheel and gear in a plurality of different angular relations to each other, said interengageable locking means including a projection on the gear and angularly spaced receiving socket means on the wheel for receiving said projection at said different angular relations between the wheel and gear, and spring means urging the wheel into interlocking relation with the gear, the wheel being disengageable from the gear by lifting movement axially of the sleeve member against the bias of said spring means to vary the angular relation of the wheel and gear.

2. The gemstone faceting holder of claim 1, wherein said projection comprises a pin member projecting from the gear, and said receiving socket means comprises respective spaced apertures in said wheel located to receive said pin member.

3. The gemstone faceting holder of claim 2, and wherein said sleeve member is provided with a bearing flange and said spring means comprises a coil spring bearing between said flange and said wheel.

4. The gemstone faceting holder of claim 2, and wherein said sleeve member has an integral flange and said pin member is affixed to said integral flange and passes through an aperture in said gear to one of said apertures in the indexing wheel.

5. The gemstone faceting holder of claim 4, and wherein said sleeve member is provided with a bushing element having a bearing flange and said spring means comprises a coil spring surrounding said bushing element and bearing between said bearing flange and said wheel.

6. The gemstone faceting holder of claim 1, and wherein said wheel is made of transparent material.

7. The gemstone holder of claim 5, and wherein said bushing element is threadedly engaged on said sleeve member.

* * * * *